US011842837B2

(12) United States Patent
Huang et al.

(10) Patent No.: US 11,842,837 B2
(45) Date of Patent: Dec. 12, 2023

(54) DRY-TYPE TRANSFORMER WITH ELLIPTICAL IRON CORE

(71) Applicant: Zhongbian Group Shanghai Transformer Co., Ltd., Shanghai (CN)

(72) Inventors: Xinle Huang, Shanghai (CN); Jin Tao, Shanghai (CN); Wei Huang, Shanghai (CN)

(73) Assignee: Zhongbian Group Shanghai Transformer Co., Ltd., Shanghai (CN)

( * ) Notice: Subject to any disclaimer, the term of this patent is extended or adjusted under 35 U.S.C. 154(b) by 0 days.

(21) Appl. No.: 17/789,205

(22) PCT Filed: Jan. 7, 2022

(86) PCT No.: PCT/CN2022/070647
§ 371 (c)(1),
(2) Date: Jun. 26, 2022

(87) PCT Pub. No.: WO2022/152048
PCT Pub. Date: Jul. 21, 2022

(65) Prior Publication Data

US 2023/0121908 A1 Apr. 20, 2023

(30) Foreign Application Priority Data

Jan. 15, 2021 (CN) ..... 202110052892.X

(51) Int. Cl.
*H01H 27/08* (2006.01)
*H01F 27/28* (2006.01)
(Continued)

(52) U.S. Cl.
CPC ..... *H01F 27/085* (2013.01); *H01F 27/025* (2013.01); *H01F 27/263* (2013.01); *H01F 27/2876* (2013.01); *H01F 27/306* (2013.01)

(58) Field of Classification Search
CPC .... H01F 27/085; H01F 27/025; H01F 27/263; H01F 27/2876; H01F 27/306
(Continued)

(56) References Cited

U.S. PATENT DOCUMENTS 5,163,173 A * 11/1992 Casagrande ..... H01F 29/146 336/155
5,483,405 A * 1/1996 Kaelin ..... H01F 27/022 336/98
(Continued)

FOREIGN PATENT DOCUMENTS

CN 101315826 A 12/2008
CN 105529145 A 4/2016
(Continued)

OTHER PUBLICATIONS

First official action and search report in priority application CN202110052892X, dated Jul. 13, 2021.
(Continued)

*Primary Examiner* — Anatoly Vortman
(74) *Attorney, Agent, or Firm* — Zhu Lehnhoff LLP

(57) ABSTRACT

A dry-type transformer with an elliptical iron core includes a transformer housing, a heat dissipation mechanism, an elliptical iron core, a coil, a clamping mechanism and an upper cover. The heat dissipation mechanism is arranged in a horizontal direction and fixedly assembled with the transformer housing. One end, away from the transformer housing, of the heat dissipation mechanism is in contact with ground. The elliptical iron core is arranged in a vertical direction inside the transformer housing. The coil is wound on the elliptical iron core. The clamping mechanism is sheathed on one side, away from the elliptical iron core, of the coil. The upper cover is arranged at a top end of the
(Continued)

transformer housing, and the upper cover is fixedly assembled with the transformer housing via a bolt structure.

8 Claims, 7 Drawing Sheets

(51) Int. Cl.
*H01F 27/02* (2006.01)
*H01F 27/26* (2006.01)
*H01F 27/30* (2006.01)
*H01F 27/08* (2006.01)

(58) Field of Classification Search
USPC ..... 361/694
See application file for complete search history.

(56) References Cited

U.S. PATENT DOCUMENTS 6,411,188 B1* 6/2002 Pruess ..... H01F 41/005 336/219
9,991,042 B2* 6/2018 Xu ..... H01F 27/24
2012/0068800 A1* 3/2012 Luckey ..... H01F 41/0226 336/213
2012/0212312 A1* 8/2012 Johnson ..... H01F 27/02 29/606
2016/0055959 A1* 2/2016 Xu ..... H01F 27/306 336/170
2019/0088411 A1* 3/2019 Zhi ..... H01F 30/12
2019/0267179 A1* 8/2019 Kobayashi ..... H01F 27/263
2019/0362879 A1* 11/2019 Tepper ..... H01F 27/327

FOREIGN PATENT DOCUMENTS

CN 105895331 A 8/2016
CN 106710828 A 5/2017
CN 206179651 U 5/2017
CN 208422651 U 1/2019
CN 209544066 U 10/2019
CN 212084791 U 12/2020
CN 112885577 A 6/2021

OTHER PUBLICATIONS

Notification of Grant of Invention Patent in priority application CN202110052892X , dated Aug. 3, 2021.
International Search Report in PCT/CN2022/070647, issued by ISA, dated Mar. 23, 2022.
Written Opinion of the International Search Report in PCT/CN2022/070647, issued by ISA, dated Mar. 23, 2022.
Examination Report in Britain Application No. GB220407 I. I, issued by UK Intellectual Property Office, dated May 17, 2022.

* cited by examiner

DRY-TYPE TRANSFORMER WITH ELLIPTICAL IRON CORE

TECHNICAL FIELD

The present disclosure relates to the technical field of dry-type transformers, in particular a dry-type transformer with an elliptical iron core.

BACKGROUND

A transformer is a device that changes an alternating voltage using the principle of electromagnetic induction, and a dry-type transformer refers to a transformer in which iron cores and windings are not immersed in insulating oil. Dry-type transformers are widely used in local lighting, high-rise buildings, airports and other places by virtue of their superior characteristics. Whether the traditional dry-type transformer is single-phase or three-phase, most of them are iron cores with circular cross-section and are uniformly arranged in a straight line. In addition, the coils of the dry-type transformer are mostly wound and tensioned, and a long-time use would easily cause local detachment and create a gap with the iron core. Corresponding solutions exist in the prior art, such as "CN 201922156698.7, a dry-type transformer with a coil pressing structure", but the clamping device is fixed therein, and after maintaining the clamping action for a period of time, there is no remedial measure for the coil to be detached again.

The present disclosure provides a dry-type transformer with an elliptical iron core, which uses an iron core with an elliptical cross section, wherein three-phase iron cores are arranged in a regular triangle shape, and are respectively located at each midpoint position of triangular edges, and the winding manner of the coil adjacent to the iron core is also different. In addition, a clamping mechanism is provided in the present disclosure, so as to remedy re-detachment of the coil during clamping, thereby extending a service life of the dry-type transformer. The present disclosure is further provided with a heat dissipation mechanism for performing natural cooling by utilizing gas flow characteristics, thereby ensuring efficient operation of the dry-type transformer.

SUMMARY OF THE DISCLOSURE

It is an object of the present disclosure to provide a dry-type transformer with an elliptical iron core that solves the problem set forth in the background art.

In order to solve the technical problem, the present disclosure provides the following technical solutions: a dry-type transformer with an elliptical iron core, comprising a transformer housing, a heat dissipation mechanism, an elliptical iron core, a coil, and a clamping mechanism. The heat dissipation mechanism is arranged in a horizontal direction and fixedly assembled with the transformer housing, one end, away from the transformer housing, of the heat dissipation mechanism being in contact with ground. The purposes of providing the heat dissipation mechanism are as follows. The first is to provide a supporting function for the transformer housing. The second is to disperse the heat generated in the working process of the dry-type transformer and perform cooling, so as to achieve the purpose of heat dissipation. The third is to, in the working process of the dry-type transformer, play a certain damping function to ensure smoothness of working. The elliptical iron core is arranged in a vertical direction inside the transformer housing with the coil wound on the elliptical iron core, which is the main component of the dry-type transformer in the working process. The clamping mechanism is sheathed on one side, away from the elliptical iron core, of the coil, and the arrangement is to ensure that the coil and the elliptical iron core are always in an attached state, so as to avoid local coil detachment caused by long-time use, which will not only affect the performance of the dry-type transformer, but also bring great potential safety hazards. An upper cover is provided at a top end of the transformer housing, and the upper cover is fixedly assembled with the transformer housing via a bolt structure so as to prevent dust in the air from entering an interior of the transformer housing and accumulating, thus affecting the normal use of the dry-type transformer.

Further, the elliptical iron core comprises a first elliptical iron core, a second elliptical iron core and a third elliptical iron core. The first elliptical iron core, the second elliptical iron core and the third elliptical iron core are all elliptical, and compared with a dry-type transformer with a circular iron core in cross section, a magnetic circuit is shorter, a power factor is higher, and a no-load loss and a no-load current are lower, so that a noise is further reduced. In addition, during winding, the coil can be completely attached to a surface of the elliptical iron core, and wound coil turns are compact, not easy to deform and have good short-circuit resistance. The first elliptical iron core, the second elliptical iron core and the third elliptical iron core are arranged in a regular triangle shape and respectively located at each midpoint position of triangular edges, long axis centre lines of the first elliptical iron core and the third elliptical iron core being arranged symmetrically and coinciding with positions of two triangular edges respectively, a long axis centre line of the second elliptical iron core being arranged perpendicularly to a third triangular edge, the coils on the first elliptical iron core and the third elliptical iron core being left-hand wound, and the coil on the second elliptical iron core being right-hand wound. The purpose of the arrangement is to strengthen a magnetic coupling between the coils without generating inductive electrical communication. Specifically, the first elliptical iron core and the second elliptical iron core are close to each other. When a current passes through the coil, a magnetic field induction is formed in the coil, and the induced magnetic field would generate an induced current to resist the current passing through the coil. Since the coils are wound on the first elliptical iron core and the second elliptical iron core in an opposite manner, namely, directions of loop currents thereof are opposite, and the magnetic fields generated by the coils are opposite in direction and same in magnitude, they can cancel each other out, thereby enhancing the magnetic coupling between the coils of the first elliptical iron core and the second elliptical iron core. With the same reasoning, the second elliptical iron core and the third elliptical iron core are close to each other and the coils thereof are wound in an opposite manner, and the magnetic fields of the two cancel each other out, thereby enhancing the magnetic coupling between the coils of the second elliptical iron core and the third elliptical iron core. The first elliptical iron core and the third elliptical iron core are close to each other, and the magnetic fields generated by the coils are the same in direction and are superimposed on each other. The second elliptical iron core is located on a symmetry line of the first elliptical iron core and the third elliptical iron core, and the magnetic fields generated along long axis directions thereof are opposite to each other in direction and thus cancel each other out, so that no additional induced current is generated, and the magnetic coupling between the coils of the first elliptical iron core and the third elliptical iron core remains unchanged.

Further, the clamping mechanism comprises an adaptive clamping assembly sheathed on one side, away from the elliptical iron core, of the coil. The purpose of arrange the adaptive clamp assembly is as follows. The first is to use the elastic feature thereof to ensure that the coil fits with and is attached to the elliptical iron cores of different sizes. The second is to use its elastic characteristics to play a certain damping role in the working process of the dry-type transformer. The adaptive clamping assembly comprises a collar, a tightening ring, a clamping plate and a compression spring. The collar is U-shaped and has an opening upwards, one end, away from the opening, of the collar being provided through one side, away from the elliptical iron core, of the coil, the tightening ring being provided through one side, away from the coil, of the collar, the tightening ring being located at an opening end) of the collar. The collar and the tightening ring are both insulating materials and have a certain elastic characteristic, so as to cooperate with each other to achieve clamping function of the assembly. The clamping plate is arranged symmetrically with respect to a long axis of the elliptical iron core, the clamping plate being located on one side, away from the tightening ring, of the collar, and the clamping plate being connected to the collar via the compression spring. The collar is provided with an opening upwards and sheathed on an outside of the coil, the tightening ring being provided through an opening end of the collar so that the collar is close to a surface of the coil, the clamping plate being attached to the surface of the coil, and the compression spring making an adaptive change by using its own characteristics, so as to ensure that the coil fits with and is attached to elliptical iron cores of different sizes.

Further, the clamping mechanism further comprises a monitoring assembly, wherein the monitoring assembly is located on one side, away from the elliptical iron core, of the collar, and the monitoring assembly is connected to the collar via a fixture. The monitoring assembly is configured to monitor a connection state between the coil and the iron core in real time, and if an abnormality is found, an execution command will be immediately transmitted, thereby achieving the effect. The monitoring assembly comprises a metal ball, a connecting rod, a tension spring, a support rod, a sliding block, a screw rod, and a monitoring gear. One end, away from the collar, of the fixture is connected to a centre of the screw rod, the screw rod being arranged in a horizontal direction, the monitoring gear being respectively fixedly arranged at both ends of the screw rod, the sliding block being symmetrically provided through the screw rod. The support rod is parallel with the screw rod and arranged on one side, away from the fixture, of the screw rod, the metal ball being provided through the support rod successively, and the metal ball being respectively electrically connected to the coil. The electric charge spins when moving inside the metal ball, and generates a ring-shaped magnetic field around. A direction of Lorentz force on the metal ball can be determined according to a direction of current flow and a direction of magnetic field. One end of the connecting rod is connected to the sliding block, and the other end of the connecting rod is connected to the support rod. One end of the tension spring is connected to the metal ball, and the other end of the tension spring is connected to the screw rod. The purpose of the arrangement is to exert a tensile force in the opposite direction on the metal ball during the working process of the dry-type transformer, thereby balancing the Lorentz force on the metal ball and maintaining a relative position of the metal ball. The screw rod is threaded in an opposite direction in a centrosymmetric position, the sliding block being respectively threadedly engaged with the screw rod.

Further, the clamping mechanism further comprises an actuating assembly, the actuating assembly being symmetrically arranged at both sides of the screw rod. The purpose of arranging the actuating assembly is to receive an actuating command, to assist the clamping assembly to achieve the clamping function on the coil and the elliptical iron core, to avoid an influence caused by a gap between the coil and the elliptical iron core, and to extend the service life of the dry-type transformer. The actuating assembly comprises a transmission gear, an actuating pressure ring, a lead rod and an actuating gear. The transmission gear is switched on the collar, the transmission gear being in meshing connection with the monitoring gear, the actuating pressure ring being provided through one side, away from the coil, of the collar, the actuating pressure ring being located directly below the tightening ring, the lead rod being vertically and symmetrically located at both sides of the screw rod, the lead rod being provided through the actuating pressure ring and being provided through one end, away from the opening, of the collar, the lead rod being rotatably connected to the collar, one end, away from the tightening ring, of the lead rod being fixedly provided with the actuating gear, and the actuating gear being in meshing connection with the transmission gear.

Further, the heat dissipation mechanism comprises a ventilation ring, a ventilation pipe, a first movable ring, a second movable ring and a push block. The purpose of arranging the ventilation ring is as follows. The first is to support the transformer housing. The second is to use internal gas flow to disperse heat, so as to achieve the purpose of cooling. The third is to absorb the vibration transmitted from the inside of the transformer housing to the side wall during the working process of the dry-type transformer, so as to play the role of damping the dry-type transformer and ensure the working stability. The ventilation pipe is arranged in a Union-Jack cross-shaped manner on an inner circular side of the ventilation ring, the ventilation pipe being respectively in communication with the ventilation ring. The first movable ring and the second movable ring are located above the ventilation pipe, the first movable ring and the second movable ring being located at a bottom end of the transformer housing, a certain closed space being formed therein. When heat is transferred to the heat dissipation mechanism, the gas in the closed space absorbs heat and expands to perform work, and the first movable ring and the second movable ring thus dynamically change. One end of the push block is fixedly connected to the first movable ring and the second movable ring, and the other end of the push block is slidably connected to the ventilation pipe, becoming a driving source for the gas flow inside the ventilation ring and the ventilation pipe.

Further, diameters of the first movable ring, the second movable ring and the ventilation ring successively increase, and the first movable ring and the second movable ring are elastic and are both provided with an elastic spring inside, while both ends of the elastic spring are respectively connected to the push block (25). The purpose of arranging the elastic spring is to impart an elastic feature to the first movable ring and the second movable ring, wherein the first movable ring and the second movable ring dynamically change to drive displacement of the push block, thereby achieving the purpose of driving the gas flow inside the ventilation pipe.

Further, a diameter of an inner ring, connected to the ventilation pipe, of the push block is smaller than a diameter of the ventilation pipe. The purpose of the arrangement is to drive the gas flow inside the ventilation pipe when the push block is relatively displaced by means of a mutual pressing action between the push block and the ventilation pipe.

Further, a plurality of heat conducting plates are uniformly arranged on an inner side wall of the transformer housing, the plurality of heat conducting plates being W-shaped, one side, away from the inner side wall of the transformer housing, of the plurality of heat conducting plates respectively interfering with one side, away from the elliptical iron core, of the coil, and one end, away from the clamping mechanism, of the plurality of heat conducting plates being respectively connected to the ventilation ring. The purpose of the arrangement is to use the structural characteristics thereof to disperse the heat generated in the working process of the elliptical iron core and the coil so as to avoid local heat accumulation which affects normal use of the dry-type transformer.

Compared with the prior art, the advantageous effects achieved by the dry-type transformer with an elliptical iron core according to the present disclosure are as follows.

1, The elliptical iron core comprises a first elliptical iron core, a second elliptical iron core and a third elliptical iron core, wherein the first elliptical iron core, the second elliptical iron core and the third elliptical iron core are all elliptical, and compared with the dry-type transformer with a circular iron core in cross section, the magnetic circuit of is shorter, the power factor is higher, and the no-load loss and the no-load current are lower, and thus the noise is further reduced. In addition, during the winding process, the coil can be completely attached to the surface of the elliptical iron core, and the wound coil turns are compact, not easy to deform and have good short-circuit resistance.

2, The first elliptical iron core, the second elliptical iron core and the third elliptical iron core are arranged in a regular triangle shape, and the coils on the first elliptical iron core and the third elliptical iron core are wound in a left-hand direction, while the coil on the second elliptical iron core is wound in a right-hand direction. The purpose of the arrangement is to strengthen the magnetic coupling between the coils and not to generate inductive electrical contact.

3, The clamping mechanism comprises an adaptive clamping assembly, the adaptive clamping assembly being arranged for the purposes as follows. The first is to use the elastic feature thereof to ensure that the coil fits with and is attached to the elliptical iron cores of different sizes. The second is to use its elastic characteristics to play a certain damping role in the working process of the dry-type transformer.

4, The clamping mechanism further comprises a monitoring assembly, and the monitoring assembly is arranged to monitor the connection state between the coil and the iron core in real time, and if an anomaly is found, an execution command is immediately transmitted, thereby achieving the effect.

5, The clamping mechanism further comprises an actuating assembly, wherein the actuating assembly is provided for receiving an actuating command, assisting the clamping assembly to achieve a clamping effect on the coil and the elliptical iron core, avoiding the influence of a gap between the coil and the elliptical iron core, and extending the service life of the dry-type transformer.

6, The purpose of arranging the heat dissipation mechanism is as follows. The first is to provide a supporting function for the transformer housing. The second is to disperse the heat generated in the working process of the dry-type transformer and perform cooling so as to achieve the purpose of heat dissipation. The third is to, in the working process of the dry-type transformer, play a certain damping function to ensure the smoothness of working.

BRIEF DESCRIPTION OF THE DRAWINGS

The accompanying drawings, which are included to provide a further understanding of the disclosure and constitute a part of this specification, serve to explain the disclosure together with the embodiments of the present disclosure and are not to be construed as limiting the disclosure. In the drawings.

Figure 1:
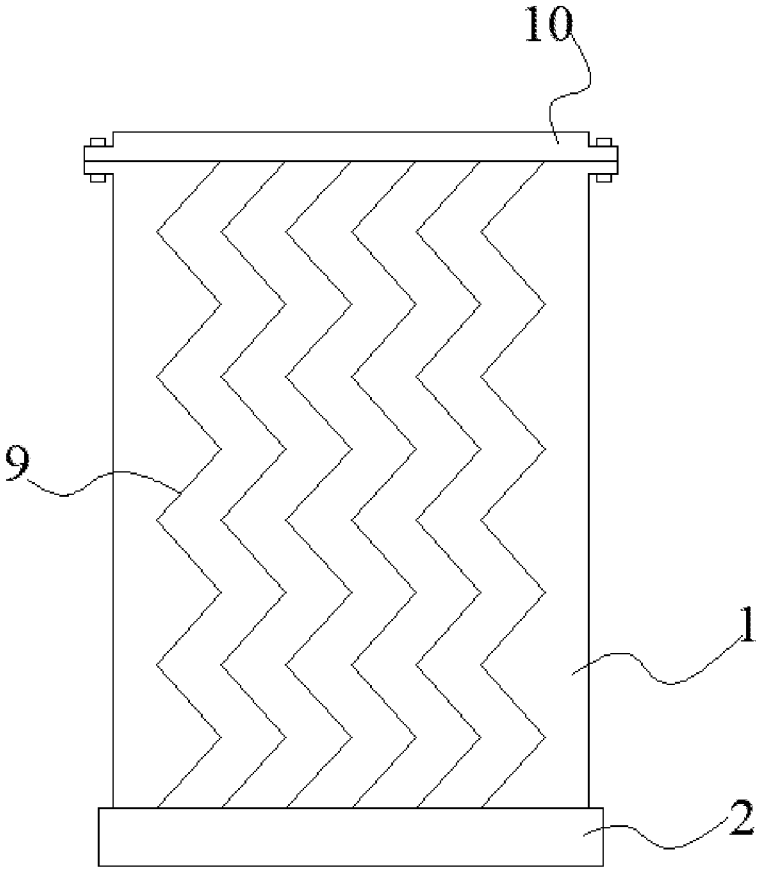
FIG. 1 is a schematic view showing an overall structure of a dry-type transformer with an elliptical iron core according to the present disclosure.

In the drawings: 1, transformer housing; 2, inner side wall; 11, heat dissipation mechanism, 21, ventilation ring, 22, ventilation pipe, 23, first movable ring, 24, second movable ring, 25, push block, 26, elastic spring, 27, inner ring; 28, air hole; 3, elliptical iron core, 31, first elliptical iron core, 32, second elliptical iron core, 33, third elliptical iron core; 4, coil; 5, clamping mechanism; 61, collar, 62, tightening ring, 63, clamping plate, 64, compression spring; 71, fixture, 72, screw rod, 73, monitoring gear, 74, sliding block, 75, support rod, 76, metal ball, 77, connecting rod, 78, tension spring; 81, transmission gear, 82, actuating pressure ring, 83, lead rod, 84, actuating gear; 9, heat conducting plate; 10, upper cover.

DETAILED DESCRIPTION OF THE PREFERRED EMBODIMENTS

The technical solutions in the embodiments of the present disclosure will now be described more clearly and fully hereinafter with reference to the accompanying drawings in the embodiments of the disclosure. It is to be understood that the embodiments described are only a few, but not all embodiments of the disclosure. Based on the embodiments of the present disclosure, all other embodiments obtained by a person of ordinary skill in the art without inventive effort fall within the scope of protection of the present disclosure.

Figure 2:
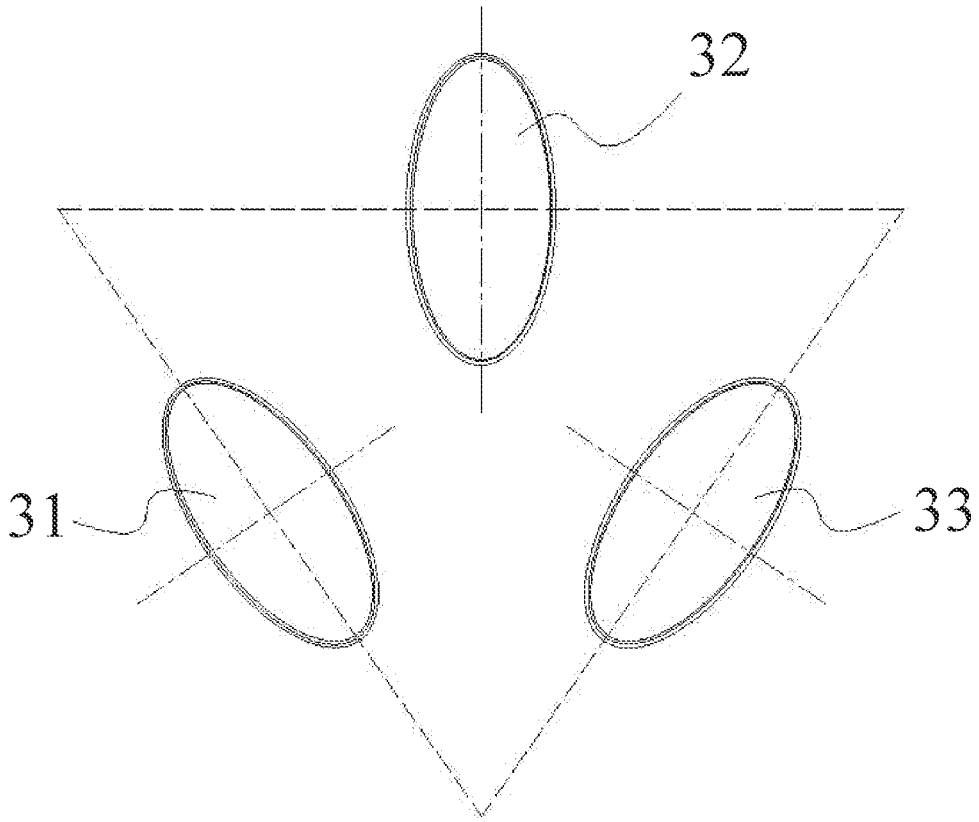
FIG. 2 is a schematic view showing an arrangement of elliptical iron cores of the dry-type transformer with an elliptical iron core according to the present disclosure.
Figure 3:
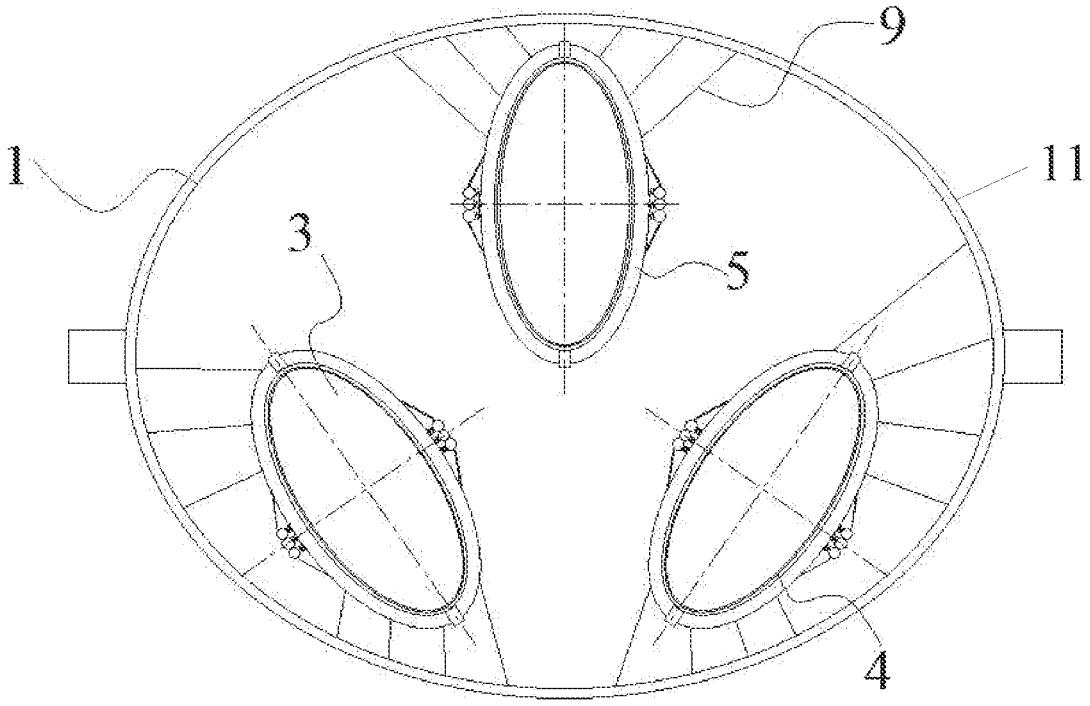
FIG. 3 is a schematic plan view showing the overall structure of the dry-type transformer with an elliptical iron core according to the present disclosure.
Figure 4:
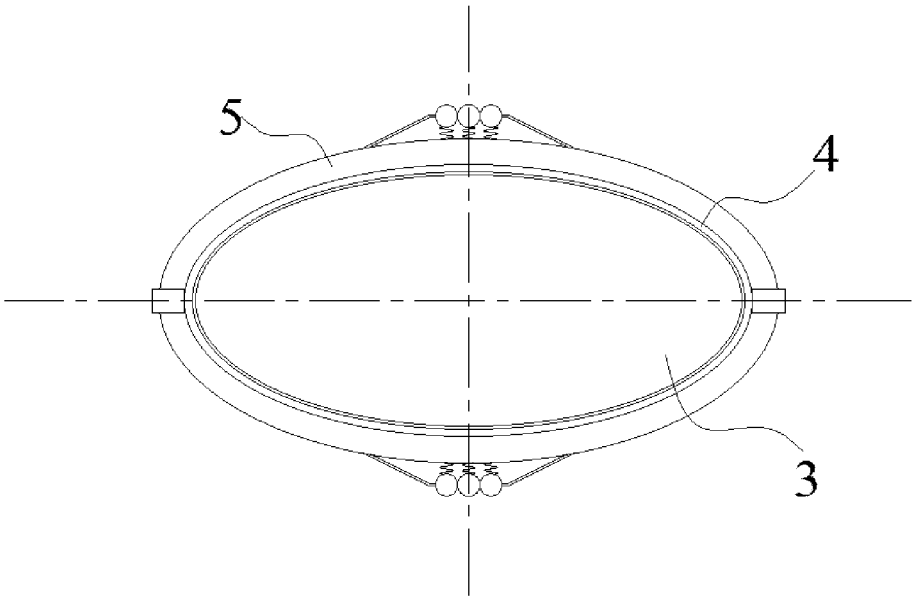
FIG. 4 is a plan view showing a structure of an elliptical iron core and a clamping mechanism of the dry-type transformer with an elliptical iron core according to the present disclosure.
Figure 5:
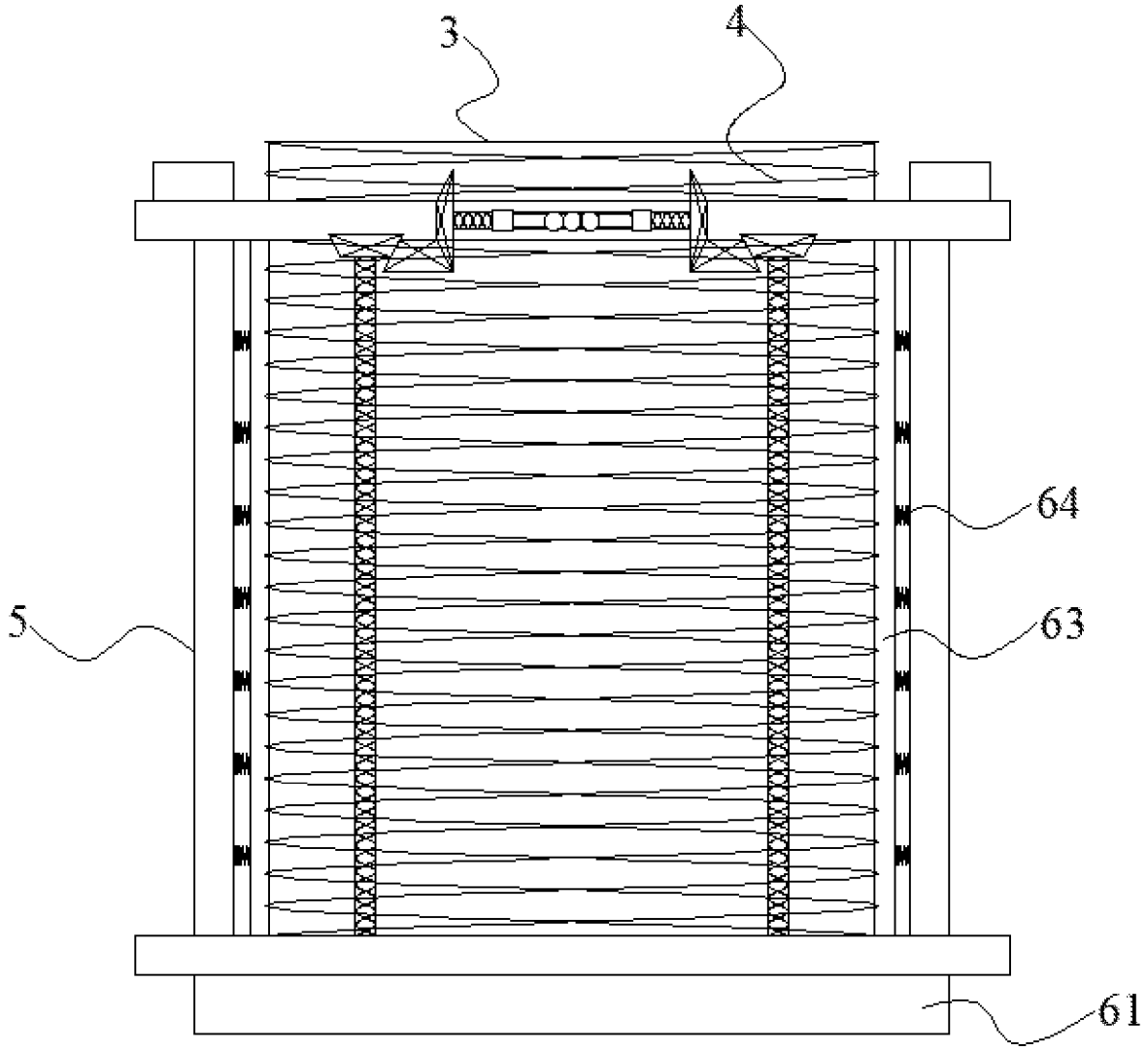
FIG. 5 is a front view showing a structure of the elliptical iron core and the clamping mechanism of the dry-type transformer with an elliptical iron core according to the present disclosure.
Figure 6:
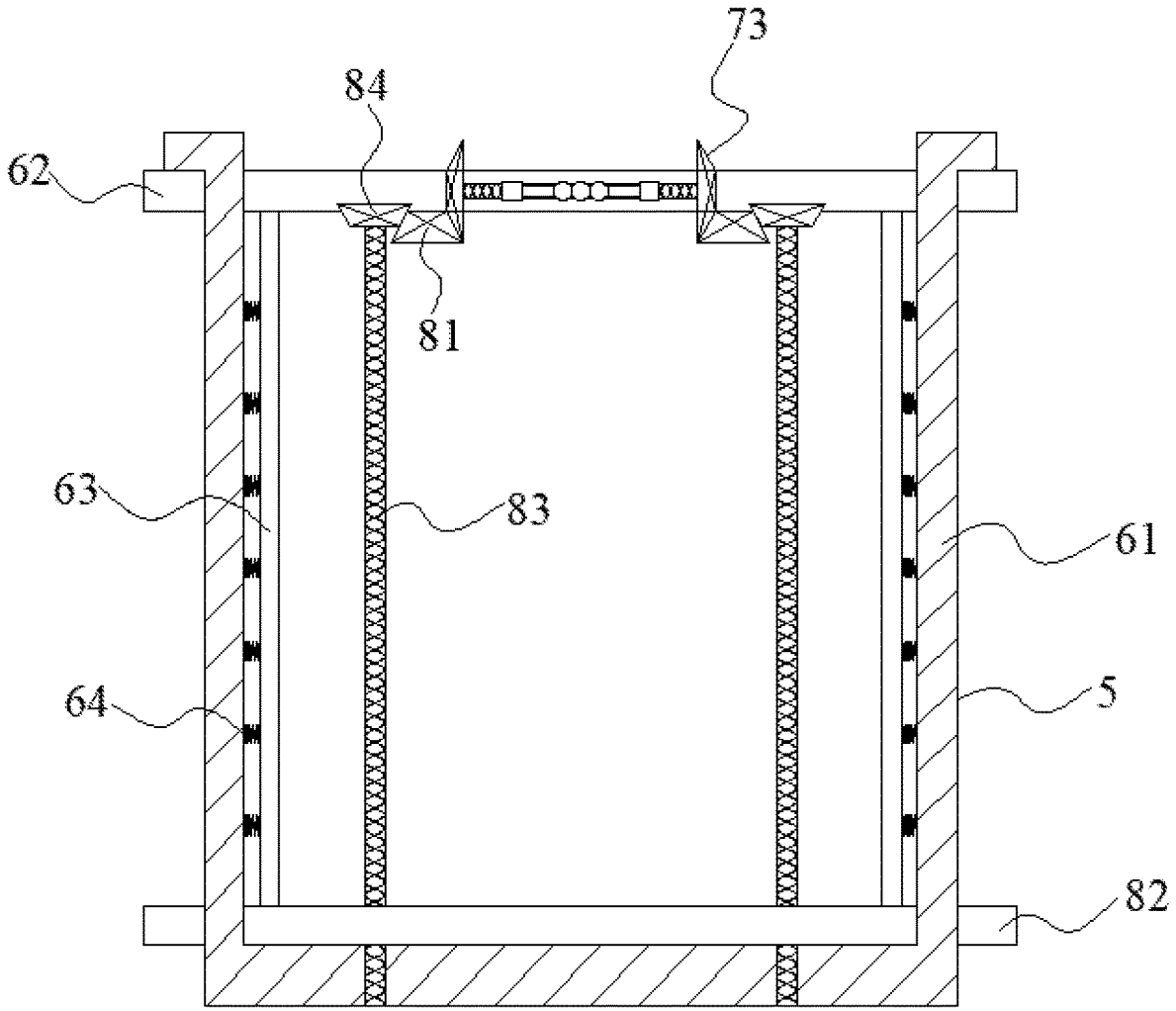
FIG. 6 is a schematic view showing a structure of the clamping mechanism of the dry-type transformer with an elliptical iron core according to the present disclosure.
Figure 7:
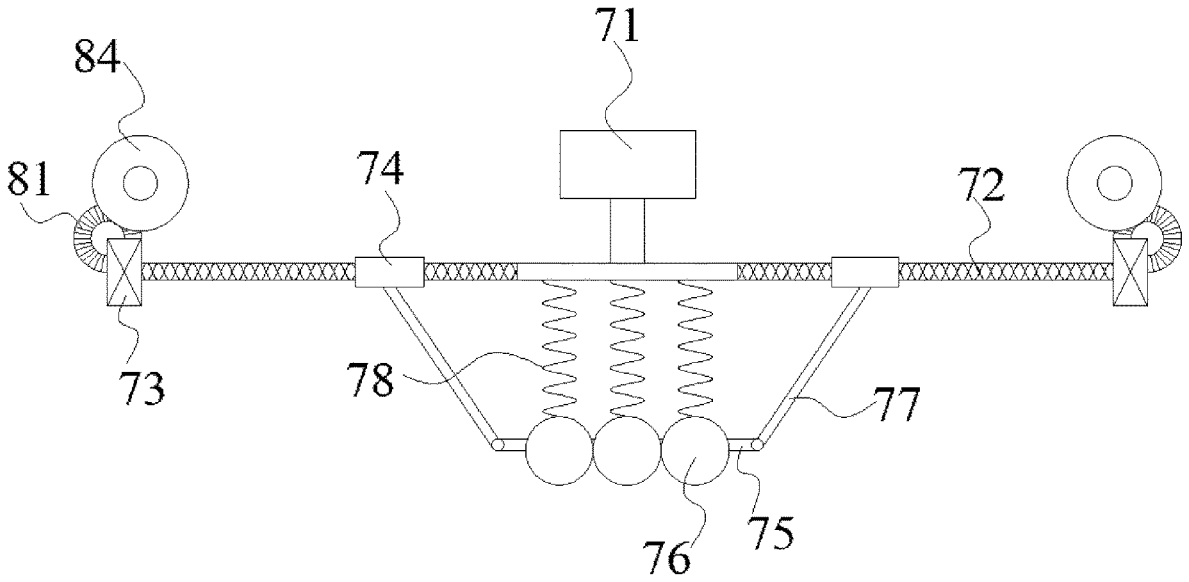
FIG. 7 is an enlarged schematic view of a partial structure of the clamping mechanism of the dry-type transformer with an elliptical iron core according to the present disclosure.
Figure 8:
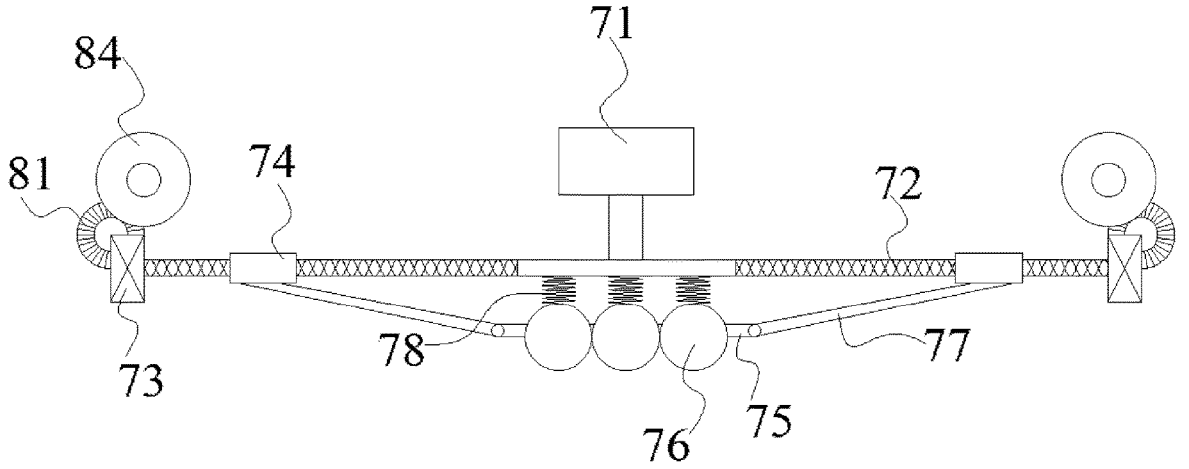
FIG. 8 is a schematic view of the working state in FIG. 7.
Figure 9:
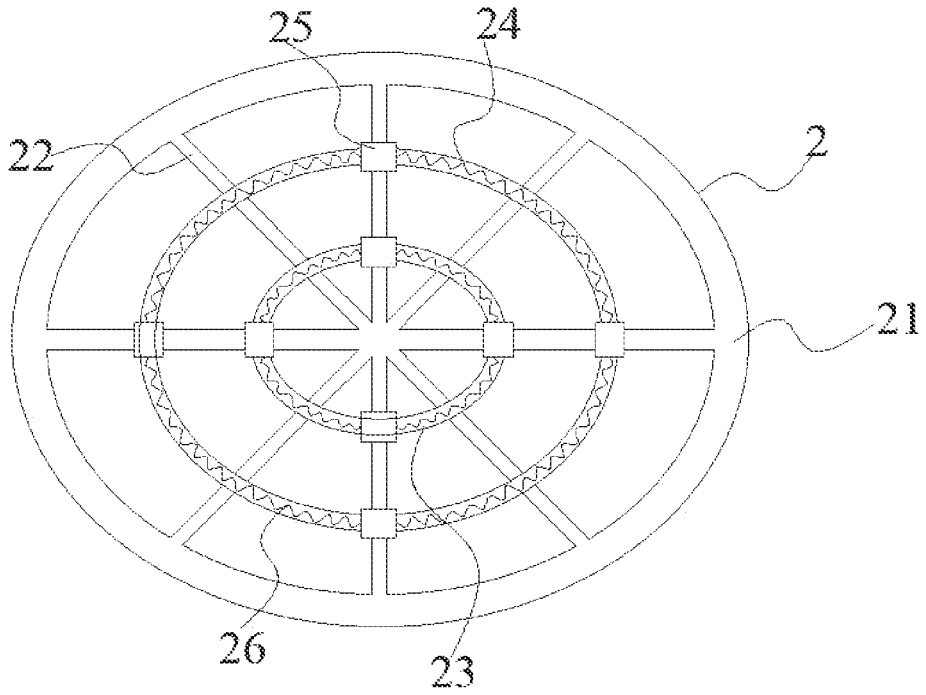
FIG. 9 is a plan view showing a structure of a heat dissipation mechanism of the dry-type transformer with an elliptical iron core according to the present disclosure.
Figure 10:
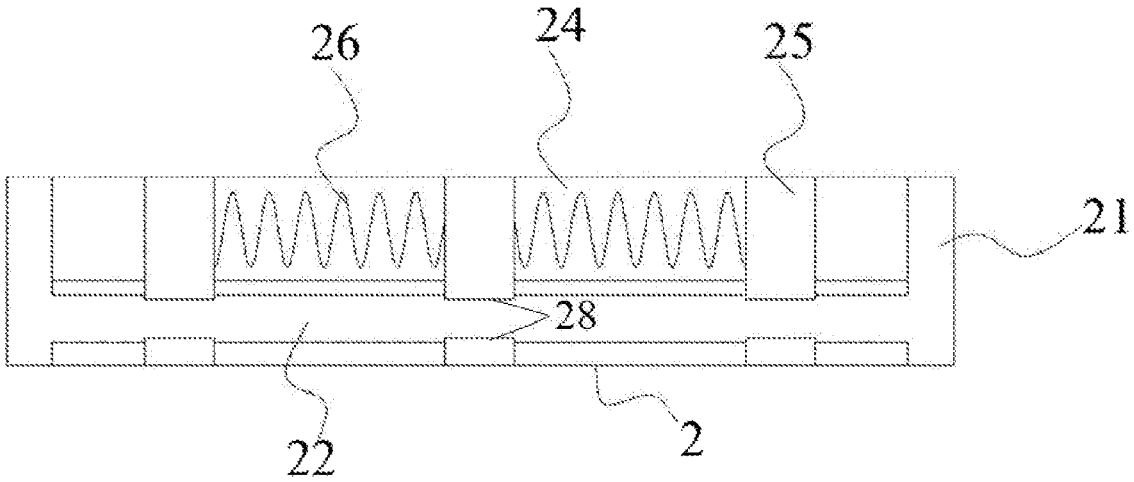
FIG. 10 is a front view showing a structure of the heat dissipation mechanism of the dry-type transformer with an elliptical iron core according to the present disclosure.

With reference to FIGS. 1-10, the present disclosure provides a technical solution: a dry-type transformer with an elliptical iron core, comprising a transformer housing 1, a heat dissipation mechanism 2, an elliptical iron core 3, a coil 4, a clamping mechanism 5 and an upper cover 10, the heat dissipation mechanism 2 being arranged in a horizontal direction and fixedly assembled with the transformer housing 1, one end, away from the transformer housing 1, of the heat dissipation mechanism 2 being in contact with ground, the elliptical iron core 3 being arranged in a vertical direction inside the transformer housing 1, the coil 4 being wound on the elliptical iron core 3, the clamping mechanism 5 being sheathed on one side, away from the elliptical iron core 3, of the coil 4, the upper cover 10 being provided at a top end of the transformer housing 1, and the upper cover 10 being fixedly assembled with the transformer housing 1 via a bolt structure.

The elliptical iron core 3 comprises a first elliptical iron core 31, a second elliptical iron core 32 and a third elliptical iron core 33, the first elliptical iron core 31, the second elliptical iron core 32 and the third elliptical iron core 33 being all elliptical, the first elliptical iron core 31, the second elliptical iron core 32 and the third elliptical iron core 33 being arranged in a regular triangle shape and respectively located at each midpoint position of triangular edges, long axis centre lines of the first elliptical iron core 31 and the third elliptical iron core 33 being arranged symmetrically and coinciding with positions of two triangular edges respectively, a long axis centre line of the second elliptical iron core 32 being arranged perpendicularly to a third triangular edge, the coils 4 on the first elliptical iron core 31 and the third elliptical iron core 33 being left-hand wound, and the coil 4 on the second elliptical iron core 32 being right-hand wound.

Specifically, the first elliptical iron core 31 and the second elliptical iron core 32 are close to each other. When a current passes through the coil 4, a magnetic field induction is formed in the coil 4, and the induced magnetic field would generate an induced current to resist the current passing through the coil 4. Since the coils 4 are wound on the first elliptical iron core 31 and the second elliptical iron core 32 in an opposite manner, namely, directions of loop currents thereof are opposite, and the magnetic fields generated by the coils 4 are opposite in direction and same in magnitude, they can cancel each other out, thereby enhancing the magnetic coupling between the coils 4 of the first elliptical iron core 31 and the second elliptical iron core 32. With the same reasoning, the second elliptical iron core 32 and the third elliptical iron core 33 are close to each other and the coils 4 thereof are wound in an opposite manner, and the magnetic fields of the two cancel each other out, thereby enhancing the magnetic coupling between the coils 4 of the second elliptical iron core 32 and the third elliptical iron core 33. The first elliptical iron core 31 and the third elliptical iron core33 are close to each other, and the magnetic fields generated by the coils 4 are the same in direction and are superimposed on each other. The second elliptical iron core 32 is located on a symmetry line of the first elliptical iron core 31 and the third elliptical iron core 33, and the magnetic fields generated along long axis directions thereof are opposite to each other in direction and thus cancel each other out, so that no additional induced current is generated, and the magnetic coupling between the coils 4 of the first elliptical iron core 31 and the third elliptical iron core 33 remains unchanged.

The clamping mechanism 5 comprises an adaptive clamping assembly sheathed on one side, away from the elliptical iron core 3, of the coil 4, the adaptive clamping assembly comprising a collar 61, a tightening ring 62, a clamping plate 63 and a compression spring 64, the collar 61 being U-shaped and having an opening upwards, one end, away from the opening, of the collar 61 being provided through one side, away from the elliptical iron core 3, of the coil 4, the tightening ring 62 being provided through one side, away from the coil 4, of the collar 61, the tightening ring 62 being located at an opening end of the collar 61, the clamping plate 63 being arranged symmetrically with respect to a long axis of the elliptical iron core 3, the clamping plate 63 being located on one side, away from the tightening ring 62, of the collar 61, and the clamping plate 63 being connected to the collar 61 via the compression spring 64.

The collar is provided with an opening upwards and sheathed on an outer surface of the coil 4, the tightening ring 62 being provided through an opening end of the collar 61 from bottom to top so that the collar 61 is close to the outer surface of the coil 4, the clamping plate 63 being attached to the outer surface of the coil, and the compression spring 64 making an adaptive change by using its own characteristics, so as to ensure that the coil 4 fits with and is attached to elliptical iron cores 3 of different sizes.

The clamping mechanism 5 further comprises a monitoring assembly, wherein the monitoring assembly is located on one side, away from the elliptical iron core 3, of the collar 61, and the monitoring assembly is connected to the collar 61 via a fixture 71, the monitoring assembly comprising a screw rod 72, a monitoring gear 73, a sliding block 74, a support rod 75, a metal ball 76, a connecting rod 77 and a tension spring 78, one end, away from the collar 61, of the fixture 71 being connected to a centre of the screw rod 72, the screw rod 72 being arranged in a horizontal direction, the monitoring gear 73 being respectively fixedly arranged at both ends of the screw rod 72, the sliding block 74 being symmetrically provided through the screw rod 72, the support rod 75 being parallel with the screw rod 72 and arranged on one side, away from the fixture 71, of the screw rod 72, the metal ball 76 being provided through the support rod 75 successively, one end of the connecting rod 77 being connected to the sliding block 74, the other end of the connecting rod 77 being connected to the support rod 75, one end of the tension spring 78 being connected to the metal ball 76, the other end of the tension spring 78 being connected to the screw rod 72, the screw rod 72 being threaded in opposite directions in a centrosymmetric position, the sliding block 74 being respectively threadedly engaged with the screw rod 72, and the metal ball 76 being respectively electrically connected to the coil 4.

The clamping mechanism 5 further comprises an actuating assembly, the actuating assembly being symmetrically arranged at both sides of the screw rod 72, the actuating assembly comprising a transmission gear 81, an actuating pressure ring 82, a lead rod 83 and an actuating gear 84, the transmission gear 81 being rotatably connected to the collar 61, the transmission gear 81 being in meshing connection with the monitoring gear 73, the actuating pressure ring 82 being provided through one side, away from the coil 4, of the collar 61, the actuating pressure ring 82 being located directly below the tightening ring 62, the lead rod 83 being vertically and symmetrically located at both sides of the screw rod 72, the lead rod 83 being provided through the actuating pressure ring 82 and being provided through one end, away from the opening, of the collar 61, the lead rod 83 being rotatably connected to the collar 61, one end, away from the tightening ring 62, of the lead rod 83 being fixedly provided with the actuating gear 84, and the actuating gear 84 being in meshing connection with the transmission gear 81.

The heat dissipation mechanism 2 comprises a ventilation ring 21, a ventilation pipe 22, a first movable ring 23, a second movable ring 24 and a push block 25, the ventilation pipe 22 being arranged in a Union-Jack cross-shaped manner on an inner circular side of the ventilation ring 21, the ventilation pipe 22 being respectively in communication with the ventilation ring 21, the first movable ring 23 and the second movable ring 24 being located above the ventilation pipe 22, one end of the push block 25 being fixedly connected to the first movable ring 23 and the second movable ring 24, and the other end of the push block 25 being slidably connected to the ventilation pipe 22.

Diameters of the first movable ring 23, the second movable ring 24 and the ventilation ring 21 successively increase, and the first movable ring 23 and the second movable ring 24 are elastic and are both provided with an elastic spring 26 inside, while both ends of the elastic spring 26 are respectively connected to the push block 25. The purpose of arranging the elastic spring 26 is to impart an elastic feature to the first movable ring 23 and the second movable ring 24, wherein the first movable ring 23 and the second movable ring 24 dynamically change to drive displacement of the push block 25, thereby achieving the purpose of driving the gas flow inside the ventilation pipe 22.

Further, a diameter of an inner ring 28, connected to the ventilation pipe 22, of the push block 25 is smaller than a diameter of the ventilation pipe 22. The purpose of the arrangement is to drive the gas flow inside the ventilation pipe 22 when the push block 25 is relatively displaced by means of a mutual pressing action between the push block 25 and the ventilation pipe 22.

A plurality of heat conducting plates 9 are uniformly arranged on an inner side wall 11 of the transformer housing 1, the plurality of heat conducting plates 9 being W-shaped, one side, away from the inner side wall 11 of the transformer housing 1, of the plurality of heat conducting plates 9 respectively interfering with one side, away from the elliptical iron core 3, of the coil 4, and one end, away from the clamping mechanism 5, of the plurality of heat conducting plates 9 being respectively connected to the ventilation ring 21. The purpose of the arrangement is to use the structural characteristics thereof to disperse the heat generated in the working process of the elliptical iron core 3 and the coil 4 so as to avoid local heat accumulation which affects normal use of the dry-type transformer.

The working principles of the present disclosure are as follows. 1, The dry-type transformer is connected to a power source, namely, the coil 4 is connected to an alternating current power source, with an alternating magnetic flux generated in the elliptical iron core 3, and the principle of electromagnetic induction is used to realize the function of changing an alternating current voltage.

2, The electric charge spins when moving inside the metal ball 76, and generates a ring-shaped magnetic field around the metal ball 76. At this time, the metal ball 76 is subjected to a Lorentz force in one direction, and the tension spring 78 exerts a tensile force in the opposite direction on the metal ball 76, thereby maintaining the relative position of the metal ball 76.

3, In the working process, the heat generated by the elliptical iron core 3 and the coil 4 can be dispersed by the plurality of heat conducting plates 9 onto the side wall of the transformer housing 1, so as to avoid local heat accumulation which affects the normal use of the dry-type transformer.

4, A certain closed space is formed inside the ventilation ring 21. The first movable ring 23 and the second movable ring 24 are located at a bottom end of the transformer housing 1 and are in direct contact therewith. Gas in the closed space absorbs heat and expands to perform work, so as to exert a thrust on an inner side wall of the push block 25, the first movable ring 23 and the second movable ring 24. Under the action of the elastic spring 26, the push block 25 drives the first movable ring 23 and the second movable ring 24 to generate a displacement, thereby driving the gas inside the ventilation pipe 22 to flow as a whole, and transmitting cold air located at a periphery of the ventilation ring 21 from the ventilation pipe 22 to the inside. Hot air inside the ventilation pipe 22 is supplemented from the inside to the outside, so as to achieve the effect of dispersing heat and achieve the purpose of cooling.

5, At the same time, the ventilation ring 21 can absorb the vibration transmitted from the inside of the transformer housing 1 to the side wall, so as to play the role of buffering and damping for the dry-type transformer and ensure the working stability.

6, When the coil 4 is loosened, a gap is generated between the coil 4 and the elliptical iron core 3. The direction of electric charge movement in the metal ball 76 is disturbed, and the direction of a magnetic field generated around the metal ball 76 is disturbed, so the magnitude and direction of the Lorentz force exerted on the metal ball 76 are changed. The tension spring 78 drives the metal ball 76 and the support rod 75 to perform a reset movement due to the elastic characteristics thereof. The support rod 75 drives the connecting rod 77 to move, so that the sliding block 74 generates a relative displacement on the screw rod 72, and the screw rod 72 drives the monitoring gear 73 to perform a rotary movement due to the relative movement with the sliding block 74.

8, The monitoring gear 73 makes a meshing movement with the transmission gear 81. The transmission gear 81 makes a meshing movement with the actuating gear 84. The actuating gear 84 drives the lead rod 83 to perform a rotary motion. The actuating pressure ring 82 performs a relative movement with the lead rod 83 so as to generate a vertical upward displacement, and a clamping function is further realized on the coil 4 and the elliptical iron core 3 so as to eliminate a gap, thereby ensuring the normal operation of the dry-type transformer.

It is noted that relational terms such as first and second, and the like, may be used herein to distinguish one entity or action from another entity or action without necessarily requiring or implying any actual such relationship or order between such entities or actions. Furthermore, the terms "including", "comprising", or any other variation thereof, are intended to cover a non-exclusive inclusion, such that a process, method, article, or apparatus that comprises a list of elements may not only include those elements but may include other elements not expressly listed or inherent to such process, method, article, or apparatus.

Finally, the foregoing description is of preferred embodiments of the present disclosure and is not intended to limit the present disclosure. It should be noted that while the present disclosure has been described in detail with reference to the foregoing embodiments, it will be understood by those skilled in the art that various changes may be made to the technical solutions recited in the foregoing embodiments, or equivalent substitutions can be made to part of the technical features therein. Thus, it is intended that the scope of protection of the present disclosure covers any changes, equivalent substitutions, improvements or the like made thereto without departing from the spirits and principles of the present disclosure.

The invention claimed is:

1. A dry-type transformer with an elliptical iron core, comprising a transformer housing, a heat dissipation mechanism, an elliptical iron core, a coil, a clamping mechanism and an upper cover, the heat dissipation mechanism being arranged in a horizontal direction and fixedly assembled with the transformer housing, one end, away from the transformer housing, of the heat dissipation mechanism being in contact with ground, the elliptical iron core being arranged in a vertical direction inside the transformer housing, the coil being wound on the elliptical iron core, the clamping mechanism being sheathed on one side, away from the elliptical iron core, of the coil, the upper cover being provided at a top end of the transformer housing, and the upper cover being fixedly assembled with the transformer housing via a bolt structure;

wherein the clamping mechanism comprises an adaptive clamping assembly sheathed on one side, away from the elliptical iron core, of the coil, the adaptive clamping assembly comprising a collar, a tightening ring, a clamping plate and a compression spring, a cross-sectional profile of the collar being U-shaped and the collar having an opening end, the end of the collar being located around a outer side of the coil, away from the elliptical iron core, the tightening ring being provided around a outer side of the collar(61), away from the coil(4), the tightening ring being located at the opening end of the collar, the clamping plate being arranged symmetrically with respect to a long axis of the elliptical iron core, the clamping plate being located on one side, away from the tightening ring, of the collar, and the clamping plate being connected to the collar via the compression spring.

2. The dry-type transformer with an elliptical iron core according to claim 1, wherein the elliptical iron core comprises a first elliptical iron core, a second elliptical iron core and a third elliptical iron core, the first elliptical iron core, the second elliptical iron core and the third elliptical iron core being arranged in a regular triangle shape and respectively located at each midpoint position of triangular edges, long axis centre lines of the first elliptical iron core and the third elliptical iron core being arranged symmetrically and coinciding with positions of two triangular edges respectively, a long axis centre line of the second elliptical iron core being arranged perpendicularly to a third triangular edge, the coils on the first elliptical iron core and the third elliptical iron core being left-hand wound, and the coil on the second elliptical iron core being right-hand wound.

3. The dry-type transformer with an elliptical iron core according to claim 1, wherein: the clamping mechanism further comprises a monitoring assembly, wherein the monitoring assembly is located on one side, away from the elliptical iron core, of the collar, and the monitoring assembly is connected to the collar via a fixture, the monitoring assembly comprising a screw rod, a monitoring gear, a sliding block, a support rod, a metal ball, a connecting rod and a tension spring, one end, away from the collar, of the fixture being connected to a centre of the screw rod, the screw rod being arranged in a horizontal direction, the monitoring gear being respectively fixedly arranged at both ends of the screw rod, the sliding block being symmetrically provided through the screw rod, the support rod being parallel with the screw rod and arranged on one side, away from the fixture, of the screw rod, the metal ball being provided through the support rod successively, one end of the connecting rod being connected to the sliding block, the other end of the connecting rod being connected to the support rod, one end of the tension spring being connected to the metal ball, the other end of the tension spring being connected to the screw rod, the screw rod being threaded in opposite directions in a centrosymmetric position, the sliding block being respectively threadedly engaged with the screw rod, and the metal ball being respectively electrically connected to the coil.

4. The dry-type transformer with an elliptical iron core according to claim 3, wherein: the clamping mechanism further comprises an actuating assembly, the actuating assembly being symmetrically arranged at both sides of the screw rod, the actuating assembly comprising a transmission gear, an actuating pressure ring, a lead rod and an actuating gear, the transmission gear being rotatably connected to the collar, the transmission gear being in meshing connection with the monitoring gear, the actuating pressure ring being provided around the outer side of the collar, away from the coil, the actuating pressure ring being located directly below the tightening ring, the lead rod being vertically and symmetrically located at both sides of the screw rod, the lead rod being provided through the actuating pressure ring and being provided through one end, away from the opening, of the collar, the lead rod being rotatably connected to the collar, a end of the lead rod closest to the tightening ring being connected to the actuating gear, and the actuating gear being in meshing connection with the transmission gear.

5. The dry-type transformer with an elliptical iron core according to claim 1, wherein: the heat dissipation mechanism comprises a ventilation ring, a ventilation pipe, a first movable ring, a second movable ring and a push block, the ventilation pipe being arranged in a Union-Jack cross-shaped manner on an inner circular side of the ventilation ring, the ventilation pipe being respectively in communication with the ventilation ring, the first movable ring and the second movable ring being located above the ventilation pipe, one end of the push block being fixedly connected to the first movable ring and the second movable ring, and the other end of the push block being slidably connected to the ventilation pipe.

6. The dry-type transformer with an elliptical iron core according to claim 5, wherein: diameters of the first movable ring, the second movable ring and the ventilation ring successively increase, and the first movable ring and the second movable ring are elastic and are both provided with an elastic spring inside, while both ends of the elastic spring are respectively connected to the push block.

7. The dry-type transformer with an elliptical iron core according to claim 6, wherein: a diameter of an inner ring, connected to the ventilation pipe, of the push block is smaller than a diameter of the ventilation pipe.

8. The dry-type transformer with an elliptical iron core according to claim 5, wherein: a plurality of heat conducting plates are uniformly arranged on an inner side wall of the transformer housing, the plurality of heat conducting plates being W-shaped, one side, away from the inner side wall of the transformer housing, of the plurality of heat conducting plates respectively interfering with one side, away from the elliptical iron core, of the coil, and one end, away from the clamping mechanism, of the plurality of heat conducting plates being respectively connected to the ventilation ring.

* * * * *